US005504664A

United States Patent [19]

Ostema

[11] Patent Number: 5,504,664

[45] Date of Patent: Apr. 2, 1996

[54] ILLUMINATED JEWELRY

[76] Inventor: Loren D. Ostema, 4411 Bee Ridge Rd., #567, Sarasota, Fla. 34233

[21] Appl. No.: 371,157

[22] Filed: Jan. 11, 1995

[51] Int. Cl.[6] ..... F21L 15/08

[52] U.S. Cl. ..... 362/104; 429/98; 362/800; 362/194

[58] Field of Search ..... 362/104, 103, 362/105, 106, 800, 194; 429/98, 99

[56] References Cited

U.S. PATENT DOCUMENTS 5,253,149 10/1993 Ostema et al. ..... 362/104

*Primary Examiner*—Carroll B. Dority
*Attorney, Agent, or Firm*—Charles J. Prescott

[57] ABSTRACT

Illuminated jewelry connectable to a wearer as an earring, a clothes pendant or the like includes a light-emitting diode (LED) connected onto an enlarged flat base member at one end of an elongated stem. A miniature battery housing also includes a stem cavity positioned immediately adjacent and generally coextensive with the battery compartment to supportively receive and closely mate with the distal portion of the stem therewithin through the use of an intermediate semi-rigid plastic tube secured within the stem cavity. The intermediate tube frictionally acts upon the stem to hold the stem at any desired depth into the tube. The stem and housing are structured so that an electrical circuit is completed between the battery and the LED through the stem when the stem is fully inserted to the bottom of the stem cavity. In this configuration, a gap between the enlarged base member and the housing generally equal to the thickness of the wearer's earlobe or article of clothing is defined. A transparent lens over the LED may be provided to enhance decorative illumination. A carbon-impregnated conductive rubber contact pad extends between one end of the battery and the stem to provide a controlled resistive restraint upon electrical power drain from the battery to the LED for extended battery life.

2 Claims, 2 Drawing Sheets

ILLUMINATED JEWELRY

BACKGROUND OF THE INVENTION

1. Scope of Invention

This invention relates generally to illuminated jewelry, and more particularly to light emitting diode-type miniature jewelry having a uniquely configured compact battery housing and stem for supporting the LED and energy conserving features.

2. Prior Art

It is well-known to utilize illuminated jewelry for earrings, body lights and for illuminated articles of clothing. However, in addition to being relatively cumbersome, such prior art devices are also relatively unreliable, short-lived and fail to achieve a desirable level of ornamentality and illumination.

One good attempt to meet these needs is disclosed in U.S. Pat. No. 4,237,525 invented by Deter which teaches illuminated jewelry using a miniature battery as an LED base for an earring for a pierced earlobe. Although this devices appears relatively compact and functional, the level of ornamentality appears to be diminished by the utilitarian structural mounting of the LED and illumination time would be limited.

A very recent patent issued to Miceli in U.S. Pat. No. 5,140,840 teaches an electrical earring for a pierced earlobe containing an LED light-enhancing display light element such as a translucent stone. However, this device is relatively complex in nature, depending on a light transmitting post for transferring light emitting from a small LED mounted against the back or base of the earring formed of a small battery.

Several other attempts toward the development of economically manufacturable, reliable and marketable LED jewelry are disclosed in U.S. Pat. Nos. 5,018,053, 4,719,544, 4,408,261 and 4,459,645. The complexity of these devices, in combination with their failure to have ever been marketed successfully, speak to their ineffectiveness.

In U.S. Pat. No. 4,271,457, Martin teaches an illuminated earring which includes an articulating conductive link serving as interconnection between the battery and the LED. Glatter further teaches an illuminating earring in U.S. Pat. No. 4,459,645 which includes an LED mounted on a base. However, the entire device is concentric and somewhat bulky.

In my previous U.S. Pat. No. 5,253,149 in which I was co-inventor, illuminated jewelry similar to the present invention was there disclosed, that invention teaching alternate means for support and electrical connection with the elongated stem of the LED and alternate energy conserving means.

The present invention represents a step beyond the above-described prior art toward a compact and acceptably decorative longer-life piece of LED-illuminated jewelry.

BRIEF SUMMARY OF THE INVENTION

This invention is directed to illuminated jewelry connectable to a wearer as an earring, a clothes pendant or the like includes a light-emitting diode (LED) connected onto an enlarged flat base member at one end of an elongated stem. A miniature battery housing also includes a stem cavity positioned immediately adjacent and generally coextensive with the battery compartment to supportively receive and closely mate with the distal portion of the stem therewithin through the use of an intermediate semi-rigid plastic tube secured within the stem cavity. The intermediate tube frictionally acts upon the stem to hold the stem at any desired depth into the tube. The stem and housing are structured so that an electrical circuit is completed between the battery and the LED through the stem when the stem is fully inserted to the bottom of the stem cavity. In this configuration, a gap between the enlarged base member and the housing generally equal to the thickness of the wearer's earlobe or article of clothing is defined. A transparent lens over the LED may be provided to enhance decorative illumination. A carbon-impregnated conductive rubber contact pad extends between one end of the battery and the stem to provide a controlled resistive restraint upon electrical power drain from the battery to the LED for extended battery life and is applicable to a broad array of battery-powered devices.

It is therefore an object of this invention to provide enhanced LED-illuminated jewelry for use as both an earring for pierced earlobes and for connection to articles of clothing.

It is yet another object of this invention to provide illuminated jewelry having a uniquely configured stem for both supporting an LED and its transparent enclosing lens, while also serving as a dual electrical conductor between the LED and miniature batteries within the compact battery housing.

It is yet another object of this invention to provide illuminated jewelry which may be worn securely with the LED either illuminated or otherwise for energy conserving.

It is yet another object of this invention to incorporate a state of the art conductive elastomeric contact pad between battery and stem in combination with an LED for inexpensive energy conservation and longer battery life.

It is still another object of this invention to utilize a carbon filled conductive elastomeric contact pad for use between one terminal of a battery of any battery-powered device and the electric energy consuming portion of that device so as to reduce current flow from the battery without significantly affecting performance of the device.

In accordance with these and other objects which will become apparent hereinafter, the instant invention will now be described with reference to the accompanying drawings.

DETAILED DESCRIPTION OF THE INVENTION

Figure 1:
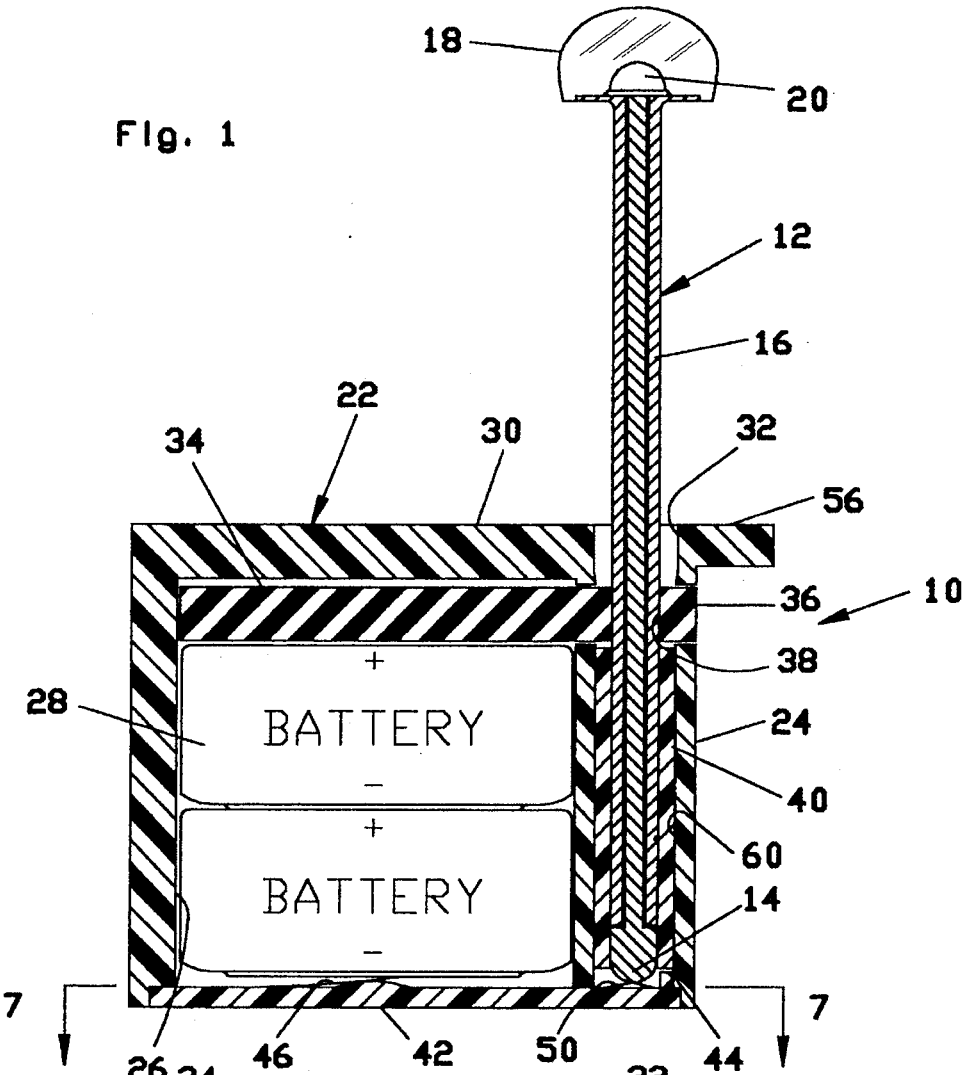
FIG. 1 is a side elevation partial section view of the invention.

Referring now to the drawings, the invention is shown in FIG. 1 generally at numeral 10 and includes a stem assembly 12 and a battery housing assembly 22. As best seen in FIG.

2, the battery housing 22 includes a plastic molded battery case 24, preferably molded of transparent plastic for decorative effect, the case 24 sized to receive a pair of miniature silver oxide batteries 28 closely fitted within a defined compartment 26 as shown.

The battery housing 22 also includes an elongated stem cavity 60 integrally formed as part of case 24, the stem cavity 60 being positioned immediately adjacent, parallel to and coextensive with the battery compartment 26. The stem cavity 60 includes an enlarged opening 32 for initial alignment of the earring stem 16 which stem 16 will be described herebelow. Also included along the length of the stem cavity 60 is a semi-rigid nonconductive tube 40 which is generally coextensive with cavity 60. This tube 40 is sized in diameter to closely conform around stem 16 so as to provide gripping friction resistance to relative movement therebetween. Tube 40 is preferably made of TEFLON impregnated plastic material, the semi-rigid characteristic being useful in preventing collapse or distortion thereof as the stem 16 is urged thereinto.

Figure 2:
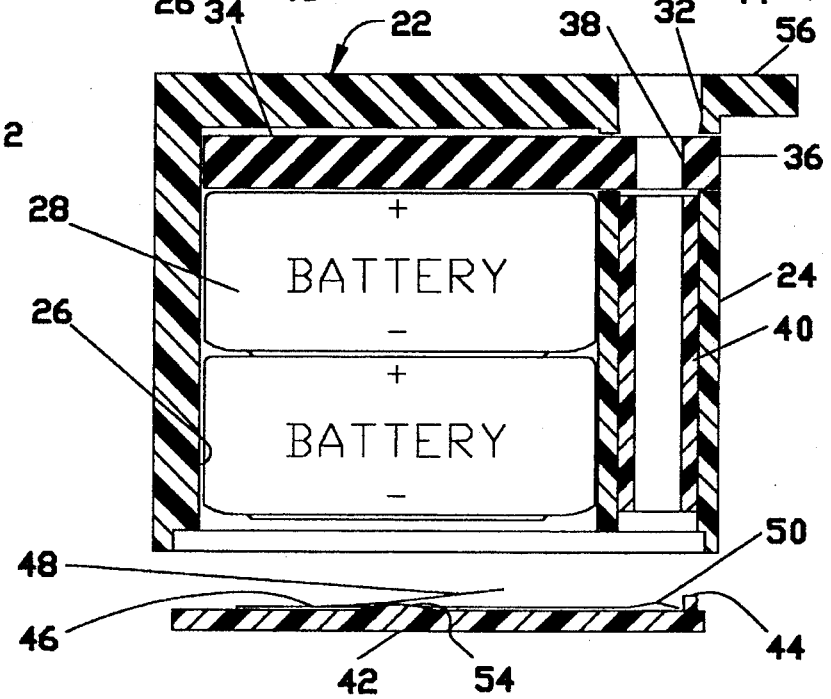
FIG. 2 is an exploded partial section view of the battery housing shown in FIG. 1
Figure 5:
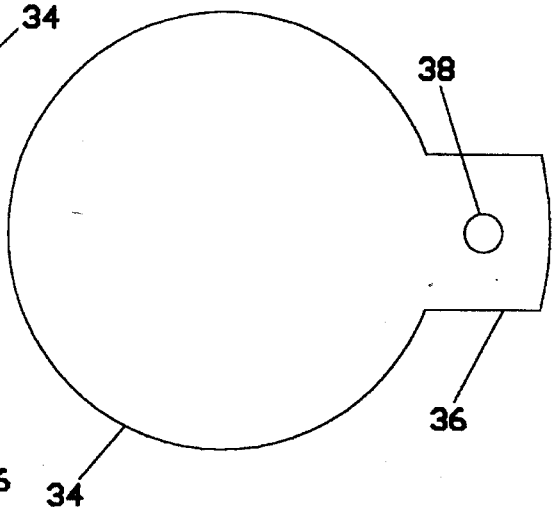
FIG. 5 is a top plan view of the positive (+) conductive elastomeric pad between battery (+) and stem of FIG. 1.
Figure 7:
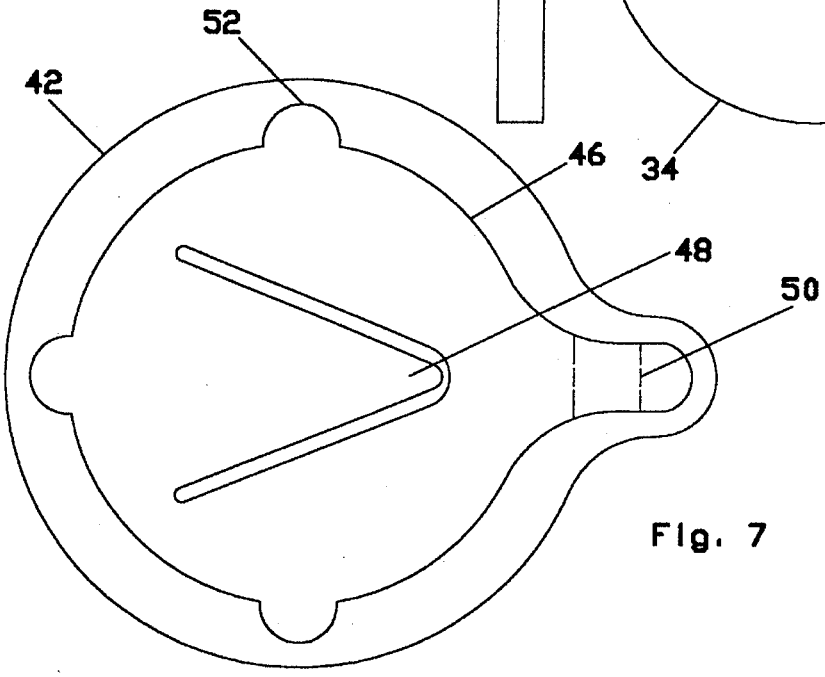
FIG. 7 is a view in the direction of arrows 7—7 in FIG. 1.

Two electrical contacts 34 and 46 are also provided within battery housing 22. A hole or aperture 38 in electrical contact pad 34 as seen in FIG. 5 is positioned at a mid point along the length of stem cavity 60 and extends into the battery compartment 26 so as to make an electrical connection with the upper (+) terminal of battery 28 as seen in FIGS. 1 and 2. The other electrical contact 46, positioned at the bottom of stem cavity 60 extends along the inner surface of bottom plate 42 to define contact 48 which biasingly bears against the negative (–) terminal of the lower battery 28 as aided by prominence 54 as best seen in FIGS. 1 and 2.

The contact pad 34 is provided so as to maximize battery life. This is accomplished through the utilization of state of the art conductive rubber in formulating contact pad 34. This conductive rubber is carbon-impregnated rubber or elastomeric material having controlled electrical resistivity. By properly selecting the level of carbon impregnation, the desired resistance to current flow is achieved while minimizing the loss in illumination performance of the LED. In FIG. 5, the contact pad 34 includes a hole 38 formed through tab 36 which snugly engages around stem 16 so as to establish positive electrical communication therebetween and also to provide further frictional resistance to movement of the stem 16 when inserted therethrough.

Figure 4:
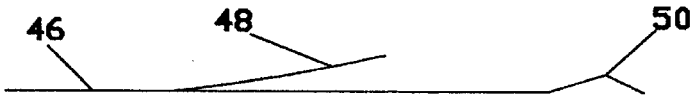
FIG. 4 is a side elevation view of FIG. 3.
Figure 3:
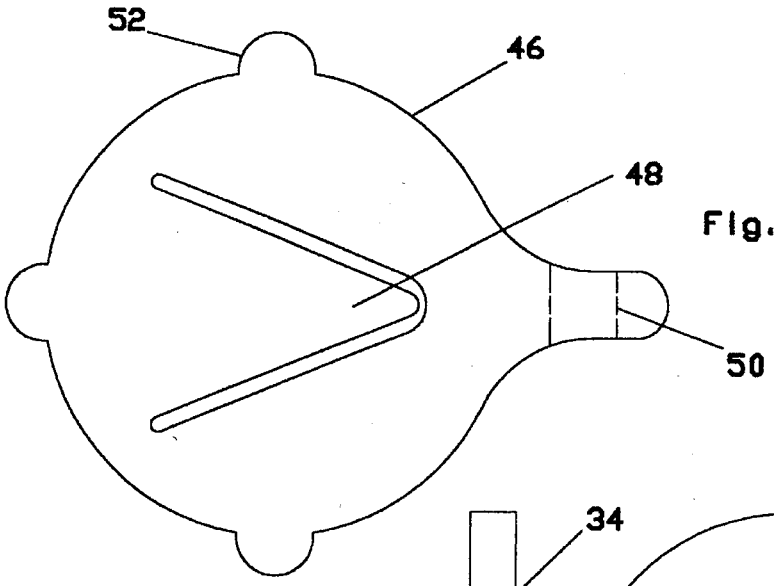
FIG. 3 is a top plan view of the negative (–) or ground electrical contact between battery (–) and stem of FIG. 1.
Figure 6:
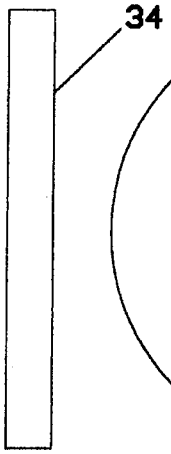
FIG. 6 is a side elevation view of FIG. 5.

Electrical contact 46 as best seen in FIGS. 3 and 4 is fabricated of thin spring metallic material having contact 48 formed out of the plane of the contact 46 so as to make electrical communication with the negative (–) side of the lower battery 28. Contact 46 also includes an upwardly bent fold line 50 which serves to provide electrical contact with the lower distal tip of the inner shaft 14 of stem assembly 12. The battery housing 22 also includes a tab or flange 56 to facilitate manipulation of the battery housing 22 during handling and installation and servicing of the batteries 28.

The stem assembly 12 as best seen in FIG. 1, includes a slender elongated cylindrical inner shaft 14 and an outer shaft 16 surrounding the inner shaft 14. Both shafts 14 and 16 are fabricated of decorative metallic material such as gold. The inner shaft 14 forms a rounded distal end of the stem at one end to facilitate installation. Reference is made to further details of this stem assembly 12 as described in U.S. Pat. No. 5,253,149.

A microchip light emitting diode (LED) 20 is mounted by its contact terminals as shown and described in FIG. 3 of U.S. Pat. No. 5,253,149. By utilizing a microchip LED 20 in the preferred embodiment, the overall size of the LED is reduced, while still affording the illumination benefits of a conventional LED.

To enhance the illumination and decorative effect of this invention 10, a transparent spherically shaped lens 18 is connected over the LED 20. This lens 18 enhances both the size and illumination effect of the device 10.

To reiterate, the stem assembly 12 is operably secured into the battery housing 22 through the use of a semi-rigid, preferably TEFLON-impregnated tube 40 secured within stem cavity 60. Stop 44, integral with bottom plate 42, prevents tube 40 from moving to the very bottom of stem cavity 60 and thus interfering with formed area 50 of electrical contact plate 46. Thus, the use of this grippingly engaging tube 40 around stem 16 eliminates the need for any detent means whatsoever. This gripping engagement is enhanced by engagement of aperture 38 of contact pad 34. The semi-rigid nature of tube 40 prevents distortion or collapse thereof even after repeated insertions of the stem 16 thereinto.

In a broad sense, the invention also discloses the utilization of a carbon-impregnated conductive rubber pad for use in conjunction with virtually any battery-powered device where a controlled resistive member acting to reduce current flow from the stored batteries, dramatically increases the effective useful life of the batteries without significantly affecting electrical performance of the device for which the batteries provide electrical power.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. In Illuminated jewelry including a light emitting diode connected onto a flat base member formed at an enlarged disc-shaped end of an elongated, cylindrical slender stem, said base member defined by a generally coplaner first and second base portion each electrically isolated one from another, said stem defined by an electrically conductive central inner shaft and an electrically conductive outer shaft which surrounds said inner shaft along a portion thereof, said inner and outer shafts electrically isolated one from another, said inner shaft coextensive with said stem and defining a generally pointed distal end thereof, an opposite end of said inner shaft extending to and integral with said first base portion, said outer shaft extending along said stem from and integral with said second base portion toward but not to said inner shaft distal end, a miniature battery housing defining a compartment for receiving and holding a miniature battery therein and also defining an elongated stem cavity generally coextensive with said housing having an open end and a bottom and positioned immediately adjacent and parallel to said compartment sized to receive and closely mate around a distal portion of said stem, said stem being in electrical contact with said battery when said stem is fully inserted into said stem cavity and said distal end is against said bottom, said stem being longer than the length of said stem cavity whereby, when said stem is fully within said stem cavity, a gap being formed between said base member and said battery housing along said stem generally equal to the thickness of a wearer's earlobe or article of clothing, the improvement comprising:

a conductive elastomeric contact pad extending between one terminal of said battery and said stem for resistive restraint upon electrical current drawn from said battery to said LED to extend the useful life of said battery.

2. In a battery-powered device including a battery housing defining a compartment for receiving and holding a battery therein and an electrical battery power-absorbing member which converts electrical current drawn from said battery for use, said battery housing also including a first and second electrical contact for electrical interconnection between each terminal of said battery and said battery-power absorbing member, the improvement comprising:

a conductive elastomeric contact pad extending between one terminal of said battery and said battery power-absorbing member for resisting restraint upon electrical current drawn from said battery to said battery power-absorbing member to extend the useful life of said battery.

* * * * *